US012050048B2

(12) United States Patent
Mi et al.

(10) Patent No.: US 12,050,048 B2
(45) Date of Patent: Jul. 30, 2024

(54) REFRIGERATOR AND BEVERAGE SUPPLY DEVICE THEREOF

(71) Applicants: QINGDAO HAIER REFRIGERATOR CO., LTD., Qingdao (CN); HAIER SMART HOME CO., LTD., Qingdao (CN)

(72) Inventors: Bo Mi, Qingdao (CN); Yanqing Zhang, Qingdao (CN); Jianjun Xue, Qingdao (CN); Chuan Cui, Qingdao (CN); Fangyou Zhang, Qingdao (CN); Guoliang Mou, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 391 days.

(21) Appl. No.: 17/624,334

(22) PCT Filed: Mar. 19, 2020

(86) PCT No.: PCT/CN2020/080131
§ 371 (c)(1),
(2) Date: Dec. 31, 2021

(87) PCT Pub. No.: WO2021/022814
PCT Pub. Date: Feb. 11, 2021

(65) Prior Publication Data

US 2022/0260306 A1 Aug. 18, 2022

(30) Foreign Application Priority Data

Aug. 6, 2019 (CN) ..... 201910721146.8

(51) Int. Cl.
*F25D 23/12* (2006.01)

(52) U.S. Cl.
CPC ..... *F25D 23/126* (2013.01); *F25D 2331/806* (2013.01)

(58) Field of Classification Search
CPC ..... F25D 23/126; F25D 2331/806; B67D 2210/00036; B67D 2210/00062;
(Continued)

(56) References Cited

U.S. PATENT DOCUMENTS 10,533,790 B2 * 1/2020 Sakthivel ..... F25D 23/126
10,563,909 B2 * 2/2020 Scalf ..... B67D 1/0011
(Continued)

FOREIGN PATENT DOCUMENTS

CN 1073149 A 6/1993
CN 2341530 Y 10/1999
(Continued)

*Primary Examiner* — Filip Zec
(74) *Attorney, Agent, or Firm* — Cheng-Ju Chiang

(57) ABSTRACT

The present invention provides a refrigerator and a beverage supply device thereof. The beverage supply device comprises: a supporting seat, an adapting seat, a liquid outlet mechanism, and a blocking member for fitting with a mouth of a beverage container, the blocking member having a channel fitted with the liquid outlet mechanism, the blocking member being disposed on the adapting seat and rotating synchronously with the adapting seat when the blocking member is located at an initially-assembled position, the beverage container is fitted to the blocking member in a state where the mouth of the beverage container is higher than a liquid level of the beverage; when the blocking member is located at a fully-assembled position, the beverage container is vertically inverted on the blocking member.

13 Claims, 8 Drawing Sheets

(58) Field of Classification Search
CPC ..... B67D 2210/00097; B67D 3/0009; B67D 3/0032; B67D 3/0083
See application file for complete search history.

(56) References Cited

U.S. PATENT DOCUMENTS

| | | | | |
|---|---|---|---|---|
| 10,824,197 | B1 * | 11/2020 | Hsu | G06F 1/1641 |
| 11,015,862 | B2 * | 5/2021 | Zhu | B67D 1/104 |
| 2007/0056314 | A1 | 3/2007 | Mali et al. | |
| 2008/0168791 | A1 * | 7/2008 | Nebbia | F25D 21/14 62/389 |
| 2010/0083686 | A1 | 4/2010 | Reels et al. | |
| 2016/0201224 | A1 * | 7/2016 | Xiang | B29C 41/42 425/7 |

FOREIGN PATENT DOCUMENTS

| | | | |
|---|---|---|---|
| CN | 200978212 | Y | 11/2007 |
| CN | 103423931 | A | 12/2013 |
| CN | 104220364 | A | 12/2014 |
| CN | 105112257 | A | 12/2015 |
| CN | 205217558 | U | 5/2016 |
| CN | 106560667 | A | 4/2017 |
| CN | 206739739 | U | 12/2017 |
| JP | 9-250869 | A | 9/1997 |

* cited by examiner

REFRIGERATOR AND BEVERAGE SUPPLY DEVICE THEREOF

The present application is a 35 U.S.C. § 371 National Phase conversion of International (PCT) Patent Application No. PCT/CN2020/080131, filed on Mar. 19, 2020, which claims priority to Chinese Patent Application No. 201910721146.8, filed to the Chinese Patent Office on Aug. 6, 2019 and titled "Refrigerator and Beverage Supply Device Thereof", the content of which is incorporated herein by reference in its entirety. The PCT International Patent Application was filed and published in Chinese.

TECHNICAL FIELD

The present invention relates to a refrigerator and a beverage supply device thereof, and belongs to the technical field of household appliance.

BACKGROUND

Usually, a refrigerator is a household appliance capable of storing food in an internal storage space at a medium or low temperature. As dietary life changes and life quality improves, more functions are provided to the refrigerator, and requirements for the performance of the refrigerator become higher and higher.

For example, refrigerators capable of conveniently supplying the user with ice or beverages (including drinking water, wine or other beverages) are gradually developed and prevail. Such refrigerators usually comprise an ice-making device for converting water into ice, a dispenser for dispensing ice or beverages to the user, and a beverage supply device for supplying beverages to the ice-making device or dispenser.

However, in the conventional beverage supply device, a container containing the beverage is usually placed with the top open, and a driving pump is used to drive the beverage to flow out of the container. As such, when the driving pump is activated each time, it generates noise of operation and causes electrical power consumption, which does not comply with requirements for low noise and low energy consumption of high-quality refrigerators.

SUMMARY

In order to at least solve technical problems with the beverage supply devices in the prior art such as large noise and high energy consumption, an object of the present invention is to provide a beverage supply device and a refrigerator with the beverage supply device, which greatly reduces noise and energy consumption.

To achieve one of the above objects of the present invention, an embodiment provides a beverage supply device, comprising:

a bracket comprising a supporting seat and an adapting seat, the adapting seat being rotatably fitted with the supporting seat about a shaft;

a liquid outlet mechanism controlled to turn on or turn off;

a blocking member fitted with a mouth of a beverage container, the blocking member having a channel fitted with the liquid outlet mechanism, the blocking member being disposed on the adapting seat and rotating synchronously with the adapting seat about the shaft, the blocking member having an initially-assembled position and a fully-assembled position on a rotation path of the blocking member;

when the blocking member is located at the initially-assembled position, the beverage container is fitted to the blocking member in a state that the mouth of the beverage container is higher than a liquid level of the beverage;

when the blocking member is located at the fully-assembled position, the beverage container is vertically inverted or obliquely inverted on the blocking member.

As a further improvement of an embodiment, the blocking member comprises a fixed end connected with the adapting seat and a free end fitted with the mouth of the beverage container; the blocking member is configured as a stopper or cylinder extending from the fixed end to the free end in a first direction; when the blocking member is located at the initially-assembled position, the first direction is vertically downward or obliquely downward; when the blocking member is located at the fully-assembled position, the first direction is vertically upward or obliquely upward.

As a further improvement of an embodiment, the liquid outlet mechanism comprises a liquid outlet pipe and a liquid injection nozzle docked upstream of the liquid outlet pipe, the liquid injection nozzle being inserted in the channel in the first direction;

the bracket further comprises a guide seat which is connected with the liquid injection nozzle and the supporting seat respectively, and the guide seat drives the liquid injection nozzle to move relative to the blocking member in the first direction when the blocking member moves from the initially-assembled position to the fully-assembled position.

As a further improvement of an embodiment, the supporting seat is provided with a guide portion which is a guide slot disposed around the shaft;

the guide seat comprises a guided portion which is inserted into the guide slot in a direction parallel to the shaft;

when the blocking member moves from the initially-assembled position to the fully-assembled position, the guide seat rotates about the shaft relative to the supporting seat, the guided portion is movable along the guide slot, and a slot wall of the guide slot abuts against the guided portion so that the guide seat moves relative to the blocking member in the first direction.

As a further improvement of an embodiment, the first direction is away from the shaft in the radial direction;

the bracket further comprises a limiting portion adapted to a flange outside the mouth of the beverage container, and when the blocking member moves from the initially-assembled position to the fully-assembled position, the limiting portion abuts against the flange to prevent the beverage container from radially moving away from the shaft.

As a further improvement of an embodiment, the supporting seat comprises two supporting plates which are oppositely disposed in a direction parallel to the shaft;

the blocking member is disposed between the two supporting plates;

the limiting portion is a rib or a groove provided on side surfaces of the two supporting plates opposite to each other, and structured as a circular arc shape with the shaft as a central axis.

As a further improvement of an embodiment, the beverage supply device further comprises an air inlet tube which is communicated with the liquid injection nozzle;

when the blocking member is located at the fully-assembled position, the liquid outlet pipe is always located below the liquid injection nozzle in the vertical direction, and an upper port of the air inlet tube is exposed to the air and vertically located above the beverage container.

As a further improvement of an embodiment, the blocking member comprises a fixed end connected with the adapting seat and a free end fitted with the mouth of the beverage container; the blocking member is configured as a stopper extending in the first direction from the fixed end to the free end, and the channel runs through the free end and the fixed end;

the free end has at least two elastic claws which surround the circumference of the channel and gather toward a center of the channel;

when the blocking member is located at the fully-assembled position, a lead-in end of the liquid outlet mechanism passes through the free end and drives the elastic claws to flare outward radially away from the channel.

As a further improvement of an embodiment, the bracket further comprises a snap-fitting seat; when the blocking member is located at the fully-assembled position, the snap-fitting seat is fitted to at least one of the adapting seat, the blocking member and the beverage container, to prevent the blocking member from moving away from the fully-assembled position to the initially-assembled position;

the snap-fitting seat comprises two elastic arms, the two elastic arms are arranged opposite to each other in a direction parallel to the shaft, and the two elastic arms enclose to form an accommodating cavity adapted for the beverage container.

Another object of the present invention is to develop a refrigerator comprising a beverage supply device, the beverage supply device comprises:

a bracket comprising a supporting seat and an adapting seat, the adapting seat being rotatably fitted with the supporting seat about a shaft;

a liquid outlet mechanism controlled to turn on or turn off;

a blocking member fitted with a mouth of a beverage container, the blocking member having a channel fitted with the liquid outlet mechanism, the blocking member being disposed on the adapting seat and rotating synchronously with the adapting seat about the shaft, the blocking member having an initially-assembled position and a fully-assembled position on a rotation path of the blocking member;

when the blocking member is located at the initially-assembled position, the beverage container is fitted to the blocking member in a state that the mouth of the beverage container is higher than a liquid level of the beverage; when the blocking member is located at the fully-assembled position, the beverage container is vertically inverted or obliquely inverted on the blocking member.

As a further improvement of an embodiment, the blocking member comprises a fixed end connected with the adapting seat and a free end fitted with the mouth of the beverage container; the blocking member is configured as a stopper or cylinder extending from the fixed end to the free end in a first direction; when the blocking member is located at the initially-assembled position, the first direction is vertically downward or obliquely downward; when the blocking member is located at the fully-assembled position, the first direction is vertically upward or obliquely upward.

As a further improvement of an embodiment, the liquid outlet mechanism comprises a liquid outlet pipe and a liquid injection nozzle docked upstream of the liquid outlet pipe, the liquid injection nozzle being inserted in the channel in the first direction;

the bracket further comprises a guide seat which is connected with the liquid injection nozzle and the supporting seat respectively, and the guide seat drives the liquid injection nozzle to move relative to the blocking member in the first direction when the blocking member moves from the initially-assembled position to the fully-assembled position.

As a further improvement of an embodiment, the supporting seat is provided with a guide portion which is a guide slot disposed around the shaft;

the guide seat comprises a guided portion which is inserted into the guide slot in a direction parallel to the shaft;

when the blocking member moves from the initially-assembled position to the fully-assembled position, the guide seat rotates about the shaft relative to the supporting seat, the guided portion is movable along the guide slot, and a slot wall of the guide slot abuts against the guided portion so that the guide seat moves relative to the blocking member in the first direction.

As a further improvement of an embodiment, the first direction is away from the shaft in the radial direction;

the bracket further comprises a limiting portion adapted to a flange outside the mouth of the beverage container, and when the blocking member moves from the initially-assembled position to the fully-assembled position, the limiting portion abuts against the flange to prevent the beverage container from radially moving away from the shaft.

As a further improvement of an embodiment, the supporting seat comprises two supporting plates which are oppositely disposed in a direction parallel to the shaft;

the blocking member is disposed between the two supporting plates;

the limiting portion is a rib or a groove provided on side surfaces of the two supporting plates opposite to each other, and structured as a circular arc shape with the shaft as a central axis.

As a further improvement of an embodiment, the beverage supply device further comprises an air inlet tube which is communicated with the liquid injection nozzle;

when the blocking member is located at the fully-assembled position, the liquid outlet pipe is always located below the liquid injection nozzle in the vertical direction, and an upper port of the air inlet tube is exposed to the air and vertically located above the beverage container.

As a further improvement of an embodiment, the blocking member comprises a fixed end connected with the adapting seat and a free end fitted with the mouth of the beverage container; the blocking member is configured as a stopper extending in the first direction from the fixed end to the free end, and the channel runs through the free end and the fixed end;

the free end has at least two elastic claws which surround the circumference of the channel and gather toward a center of the channel;

when the blocking member is located at the fully-assembled position, a lead-in end of the liquid outlet mechanism passes through the free end and drives the elastic claws to flare outward radially away from the channel.

As a further improvement of an embodiment, the bracket further comprises a snap-fitting seat; when the blocking member is located at the fully-assembled position, the snap-fitting seat is fitted to at least one of the adapting seat, the blocking member and the beverage container, to prevent the blocking member from moving away from the fully-assembled position to the initially-assembled position;

the snap-fitting seat comprises two elastic arms, the two elastic arms are arranged opposite to each other in a direction parallel to the shaft, and the two elastic arms enclose to form an accommodating cavity adapted for the beverage container.

As a further improvement of an embodiment, the refrigerator comprises a cabinet, a door movably assembled on the front of the cabinet and a beverage demanding device; the beverage supply device is disposed on a back portion of the door through the supporting seat, and connected to the beverage demanding device to controllably deliver the beverage to the beverage demanding device.

As a further improvement of an embodiment, the beverage demanding device comprises any one or two of an ice maker and a dispenser.

As a further improvement of an embodiment, the beverage demanding device comprises a dispenser, the liquid outlet mechanism comprises a liquid outlet pipe and a liquid injection nozzle docked upstream of the liquid outlet pipe, the liquid outlet pipe comprises a conduit fitted with the liquid injection nozzle and a valve fitted downstream of the conduit, and the valve is assembled on the dispenser.

As compared with the prior art, the present invention has the following advantageous effects: when a blocking member is connected on a supporting seat in a way the blocking member is rotatable about a shaft through an adapting seat; when the beverage container needs to be mounted on the beverage supply device, the blocking member is made rotate to an initially-assembled position, whereupon the beverage container is mounted on the blocking member in a state that the mouth of the beverage container is higher than the liquid level of the beverage, then the blocking member is rotated about the shaft to the fully-assembled position so that the beverage container is inverted so that the beverage is accessed by the user. As such, the beverage may flow out of the beverage container under the action of gravity, a driving pump needn't be configured, and problems such as the noise pollution and high energy consumption caused by the driving pump are avoided. Furthermore, the mating of the blocking member and the mouth of the beverage container avoids the spill of the beverage out of the beverage container, and provides the user with optimal experience.

Another object of the present invention is to develop a beverage supply device, and develop a refrigerator employing the beverage supply device.

To achieve one of the above objects of the present invention, an embodiment provides a beverage supply device, comprising:

a bracket comprising a supporting seat, an adapting seat and a guide seat, the adapting seat and the guide seat being both movably fitted with the supporting seat;

a liquid outlet mechanism controlled to turn on or turn off and comprising a liquid outlet pipe and a liquid injection nozzle docked upstream of the liquid outlet pipe, the liquid injection nozzle being disposed on the guide seat;

a blocking member having a channel into which the liquid injection nozzle is inserted in a first direction, the blocking member being disposed on the adapting seat and moving synchronously with the adapting seat in a second direction from an initially-assembled position to a fully-assembled position;

when the blocking member is located at the initially-assembled position, the blocking member engages with or disengage from a mouth of a beverage container;

when the blocking member moves in the second direction from the initially-assembled position, the liquid injection nozzle, driven by the guide seat, moves relative to the blocking member in the first direction, to increase a distance of intrusion of the liquid injection nozzle into the channel.

As a further improvement of an embodiment, the blocking member rotates with the adapting seat about a shaft in the second direction; the first direction is away from or close to the shaft in a radial direction.

As a further improvement of an embodiment, the supporting seat is provided with a guide portion which is a guide slot disposed around the shaft;

the guide seat includes a guided portion which is inserted into the guide slot in a direction parallel to the shaft;

when the blocking member moves in the second direction, the guide seat rotates about the shaft relative to the supporting seat, the guided portion is movable along the guide slot, and a slot wall of the guide slot abuts against the guided portion so that the guide seat moves relative to the blocking member in the first direction.

As a further improvement of an embodiment, the first direction is away from the shaft in the radial direction;

the bracket further comprises a limiting portion adapted to a flange outside the mouth of the beverage container, and when the blocking member moves in the second direction, the limiting portion abuts against the flange to prevent the beverage container from radially moving away from the shaft.

As a further improvement of an embodiment, the supporting seat comprises two supporting plates which are oppositely disposed in a direction parallel to the shaft;

the blocking member is disposed between the two supporting plates;

the limiting portion is a rib or a groove provided on side surfaces of the two supporting plates opposite to each other, and structured as a circular arc shape with the shaft as a central axis.

As a further improvement of an embodiment, when the blocking member is located at the initially-assembled position, the beverage container is fitted to the blocking member in a state where the mouth of the beverage container is higher than a liquid level of the beverage; when the blocking member is located at the fully-assembled position, the beverage container is vertically inverted or obliquely inverted on the blocking member.

As a further improvement of an embodiment, the blocking member is configured as a flexible stopper, which comprises a fixed end connected with the adapting seat and a free end fitted with the mouth of the beverage container;

the channel runs through the free end and the fixed end, and extends in the first direction and at least a partial area thereof has a tapering inner diameter; the liquid injection nozzle includes a pointed mouth whose outer diameter is reduced in the first direction, the pointed mouth is inserted into the channel, and an outer surface of the pointed mouth is attached to an inner surface of the channel.

As a further improvement of an embodiment, the free end has at least two elastic claws which surround the circumference of the channel and gather toward a center of the channel;

when the blocking member is located at the fully-assembled position, a lead-in end of the liquid outlet mechanism passes through the free end and drives the elastic claws to flare outward radially away from the channel.

As a further improvement of an embodiment, the beverage supply device further comprises an air inlet tube which is communicated with the liquid injection nozzle;

when the blocking member is located at the fully-assembled position, the liquid outlet pipe is always located below the liquid injection nozzle in the vertical direction, and an upper port of the air inlet tube is exposed to the air and vertically located above the beverage container.

In order to achieve one of the above-mentioned objects of the invention, an embodiment further provides a refrigerator comprising a beverage supply device, the beverage supply device comprising:

a bracket comprising a supporting seat, an adapting seat and a guide seat, the adapting seat and the guide seat being both movably fitted with the supporting seat;

a liquid outlet mechanism controlled to turn on or turn off and comprising a liquid outlet pipe and a liquid injection nozzle docked upstream of the liquid outlet pipe, the liquid injection nozzle being disposed on the guide seat;

a blocking member having a channel into which the liquid injection nozzle is inserted in a first direction, the blocking member being disposed on the adapting seat and moving synchronously with the adapting seat in a second direction from an initially-assembled position to a fully-assembled position;

when the blocking member is located at the initially-assembled position, the blocking member engages with or disengage from a mouth of a beverage container;

when the blocking member moves in the second direction from the initially-assembled position, the liquid injection nozzle, driven by the guide seat, moves relative to the blocking member in the first direction, to increase a distance of intrusion of the liquid injection nozzle into the channel.

As a further improvement of an embodiment, the blocking member rotates with the adapting seat about a shaft in the second direction; the first direction is away from or close to the shaft in a radial direction.

As a further improvement of an embodiment, the supporting seat is provided with a guide portion which is a guide slot disposed around the shaft;

the guide seat includes a guided portion which is inserted into the guide slot in a direction parallel to the shaft;

when the blocking member moves in the second direction, the guide seat rotates about the shaft relative to the supporting seat, the guided portion is movable along the guide slot, and a slot wall of the guide slot abuts against the guided portion so that the guide seat moves relative to the blocking member in the first direction.

As a further improvement of an embodiment, the first direction is away from the shaft in the radial direction;

the bracket further comprises a limiting portion adapted to a flange outside the mouth of the beverage container, and when the blocking member moves in the second direction, the limiting portion abuts against the flange to prevent the beverage container from radially moving away from the shaft.

As a further improvement of an embodiment, the supporting seat comprises two supporting plates which are oppositely disposed in a direction parallel to the shaft;

the blocking member is disposed between the two supporting plates;

the limiting portion is a rib or a groove provided on side surfaces of the two supporting plates opposite to each other, and structured as a circular arc shape with the shaft as a central axis.

As a further improvement of an embodiment, when the blocking member is located at the initially-assembled position, the beverage container is fitted to the blocking member in a state where the mouth of the beverage container is higher than a liquid level of the beverage; when the blocking member is located at the fully-assembled position, the beverage container is vertically inverted or obliquely inverted on the blocking member.

As a further improvement of an embodiment, the blocking member is configured as a flexible stopper, which comprises a fixed end connected with the adapting seat and a free end fitted with the mouth of the beverage container;

the channel runs through the free end and the fixed end, and extends in the first direction and at least a partial area thereof has a tapering inner diameter; the liquid injection nozzle includes a pointed mouth whose outer diameter is reduced in the first direction, the pointed mouth is inserted into the channel, and an outer surface of the pointed mouth is attached to an inner surface of the channel.

As a further improvement of an embodiment, the free end has at least two elastic claws which surround the circumference of the channel and gather toward a center of the channel;

when the blocking member is located at the fully-assembled position, a lead-in end of the liquid outlet mechanism passes through the free end and drives the elastic claws to flare outward radially away from the channel.

As a further improvement of an embodiment, the beverage supply device further comprises an air inlet tube which is communicated with the liquid injection nozzle;

when the blocking member is located at the fully-assembled position, the liquid outlet pipe is always located below the liquid injection nozzle in the vertical direction, and an upper port of the air inlet tube is exposed to the air and vertically located above the beverage container.

As compared with the prior art, the prevent invention has the following advantageous effects: a beverage supply device capable of reliably supplying the beverage is provided; furthermore, in the beverage supply device of the present application, the guide seat is configured to be movably fitted with the supporting seat, and the liquid injection nozzle is connected to the guide seat, so that while the blocking member moves from the initially-assembled position to the fully-assembled position, the liquid injection nozzle, driven by the guide seat, gets further deeper into the channel of the blocking member, thereby enhancing the fitting firmness and tightness of the liquid injection nozzle and the blocking member, and ensuring the reliability of the beverage supply device upon outputting the beverage.

DETAILED DESCRIPTION

Figure 1:
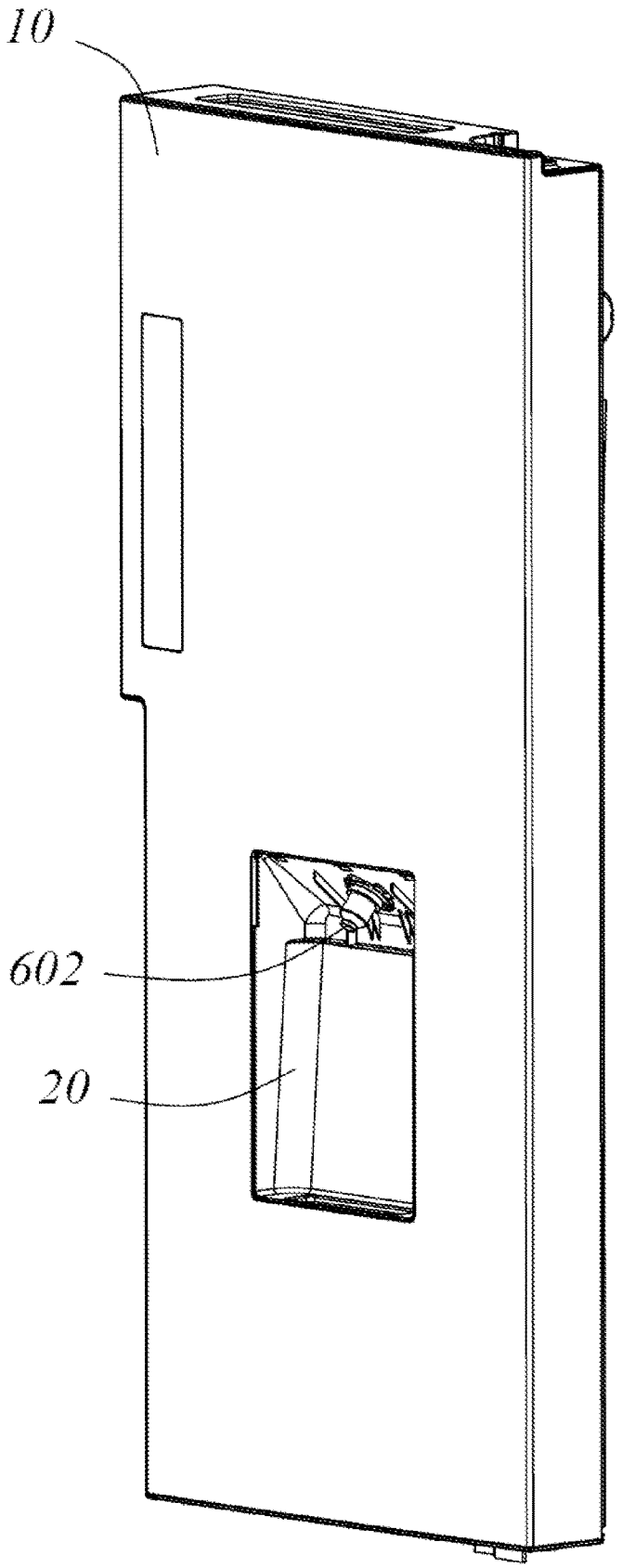
FIG. 1 is a front view of a door of a refrigerator according to an embodiment of the present invention.
Figure 2:
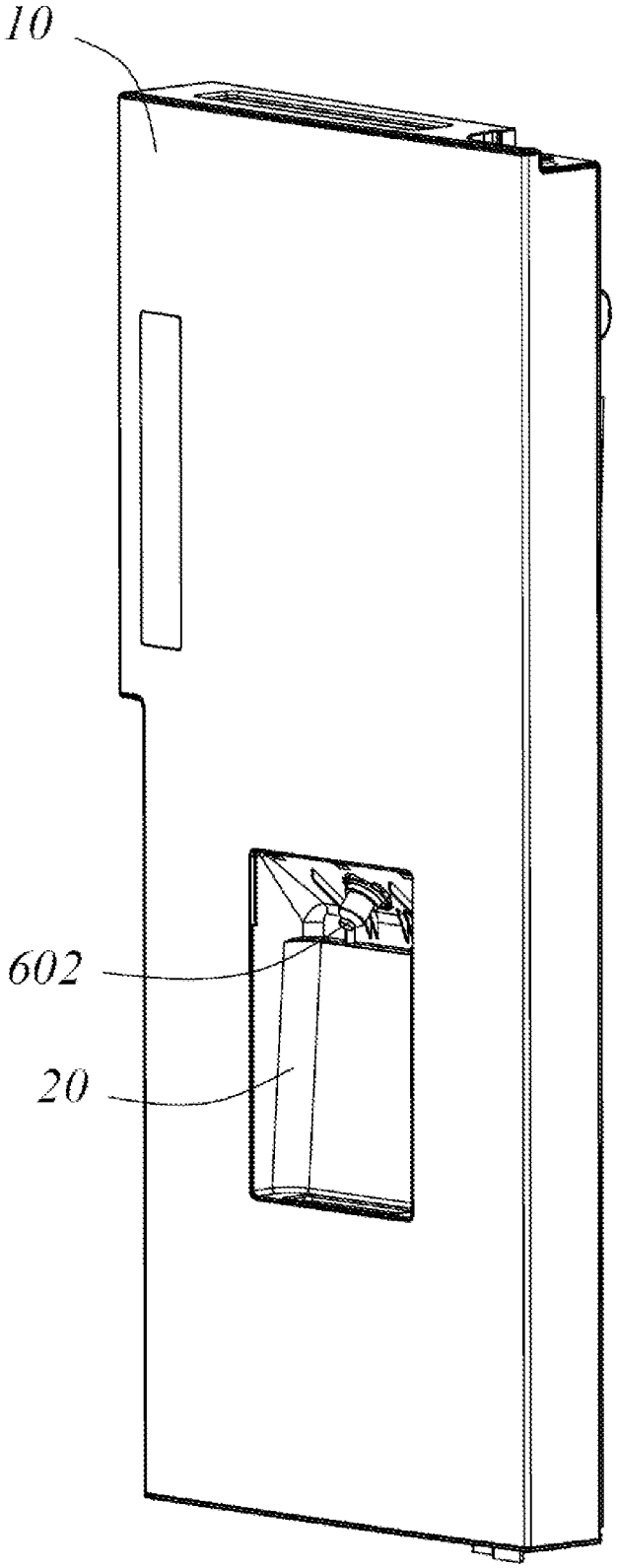
FIG. 2 is a rear view of a door of a refrigerator with a beverage container being mounted according to an embodiment of the present invention.

The implementations of the present invention will be described in detail in conjunction with specific embodiments shown in the figures. However, these embodiments are not intended to limit the present invention. Structural, methodological or functional variations made by those having ordinary skill in the art according to these implementations are all included in the extent of protection of the present invention.

Referring to FIG. 1 through FIG. 10, an embodiment provides a refrigerator comprising a cabinet, a door 10, a beverage demanding device and a beverage supply device 100.

The cabinet surrounds a storage compartment which comprises any of a refrigerating chamber, a freezing chamber, a variable temperature chamber etc., or combinations thereof. The door 10 is movably assembled to a front portion of the cabinet to open or close the storage compartment. The beverage supply device 100 is disposed on a back portion (i.e., a rear portion) of the door 10 and connected to the beverage demanding device to controllably deliver the beverage to the beverage demanding device. Preferably, the storage compartment at least comprises the refrigerating chamber, the door 10 is configured to open or close the refrigerating chamber, and correspondingly, the beverage supply device 100 may be exposed backwardly from the back portion of the door 10 into the refrigerating chamber so that the beverage is chilled other than being frozen.

The beverage demanding device may specifically comprises any one or two of an ice maker and a dispenser. In the present embodiment, the beverage demanding device is a dispenser 20, the beverage supply device 100 is connected with the dispenser 20 and controllably delivers the beverage to the dispenser 20, and the beverage may be set as drinks, wine, drinking water or other liquid beverages. In an alternative embodiment, the beverage demanding device may be set as an ice maker, and the beverage supply device 100 is configured to controllably deliver drinking water to the ice maker; or the beverage demanding device may also be set as the ice maker and the dispenser 20, and the beverage supply device 100 is configured to controllably deliver drinking water to the ice maker and the dispenser 20.

The beverage supply device 100 specifically comprises a bracket, a liquid outlet mechanism, an air inlet tube 70 and a blocking member 40.

The bracket is used to support at least one or any combination of the liquid outlet mechanism, the air inlet tube 70 and the blocking member 40, and is detachably fixed and connected to the door 10. Specifically, the bracket comprises an assembling frame 31 that is adapted to the back portion of the door 10. A middle portion of the assembling frame 31 is closely attached to a back surface of the door 10, and left and right ends of the assembling frame 31 are hung and supported on a door liner 11 of the door 10 via a buckle 311.

The bracket further comprises a supporting seat 32 and an adapting seat 33. The supporting seat 32 remains stationary with respect to the door 10; the adapting seat 33 is relatively rotatably adapted to the supporting seat 32 about a shaft 321, and the shaft 321 is set to extend horizontally in a left-right direction in the present embodiment. It may be appreciated that the extension direction of the shaft 321 is not limited to this.

Specifically, in the present embodiment, the supporting seat 32 comprises two supporting plates 320 and the shaft 321. The two supporting plates 320 are disposed oppositely and substantially parallel in the left-right direction; the shaft 321 is disposed on the two supporting plates 320 and extends horizontally in the left-right direction beyond the supporting plates 320. The adapting seat 33 is disposed between the two supporting plates 320 and comprises two adapting plates 330 and holes 331. The two adapting plates 330 are disposed oppositely in the left-right direction and substantially parallel to each other, and the two adapting plates 330 correspond to the two supporting plates 320 one to one; the holes 331 are provided on the adapting plates 330 and adapted to the shaft 321, the shaft 321 is inserted into the holes 331 and rotatable in the holes 331, so that the adapting seat 33 and the supporting seat 32 rotate relative to each other. Certainly, the connection manner of the adapting seat 33 and the supporting seat 32 is not limited to this. For example, in an alternative embodiment, the positions of the shaft 321 and the holes 331 are exchangeable, or alternatively, holes are provided on both the adapting seat 33 and the supporting seat 32, and the shaft 321 is disposed between the adapting seat 33 and the supporting seat 32.

The blocking member 40 is configured to be fitted with a mouth of a beverage container 200, and has a channel 400 at the center thereof; the liquid outlet mechanism is configured as a liquid flow path for the beverage to flow from the beverage container 200 to the dispenser 20, a lead-in end 601 of the liquid outlet mechanism is fitted at the channel 400, a discharge end 602 of the liquid outlet mechanism is fitted at the dispenser 20, and the liquid outlet mechanism is configured to turn on or turn off in a controlled manner. In this way, when the liquid outlet mechanism is controlled to turn on, that is, the liquid flow path between the lead-in end 601 and the discharge end 602 is conducted, so that the beverage in the beverage container 200 can be delivered through the liquid outlet mechanism to the dispenser 20 for access by the user; when the liquid outlet mechanism is controlled to turn off, that is, the liquid flow path between the lead-in end 601 and the discharge end 602 is cut off, so that the beverage in the beverage container 200 cannot be delivered through the liquid outlet mechanism to the dispenser 20.

Figure 3:
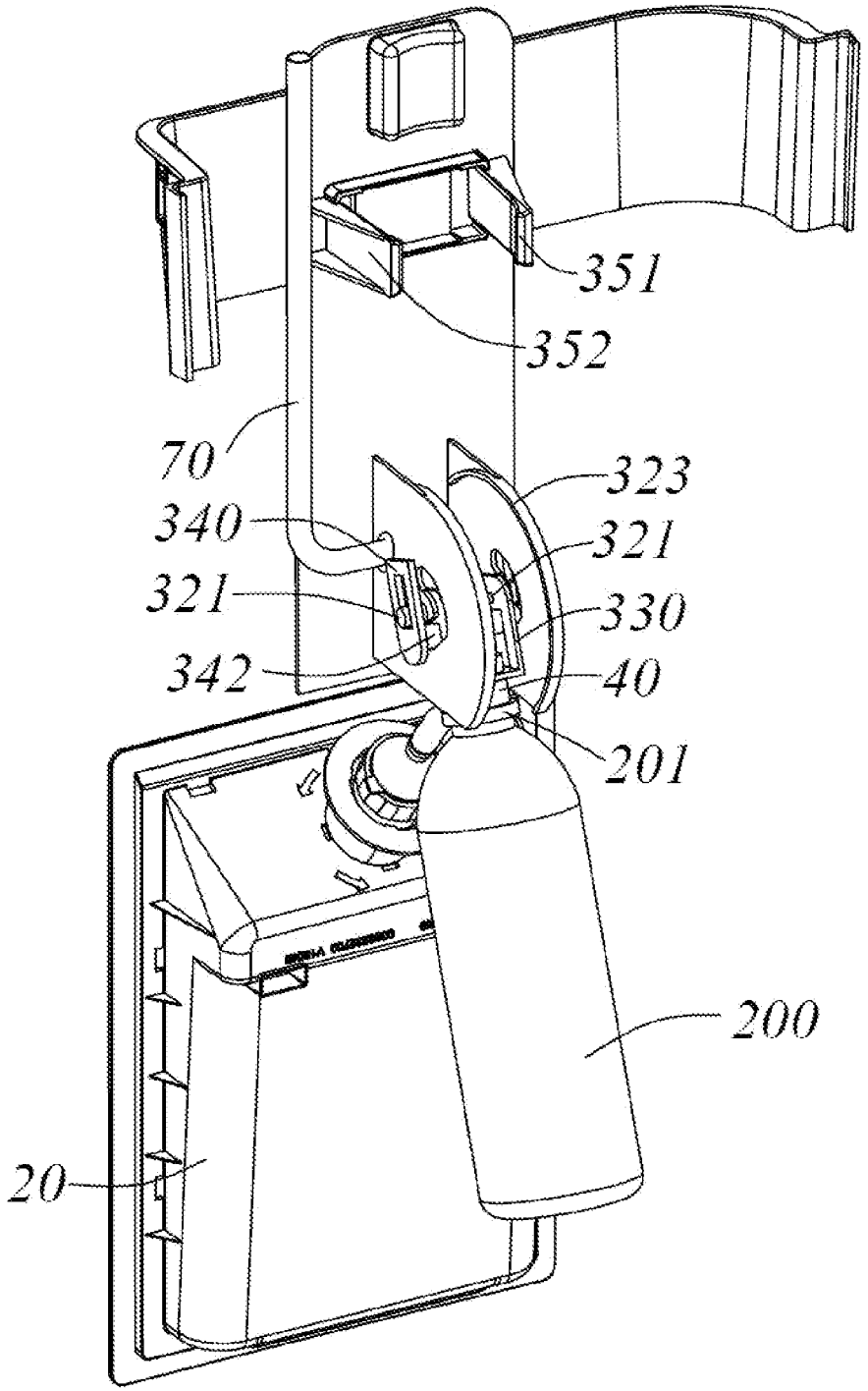
FIG. 3 is a structural schematic view of a combination of a beverage supply device and a dispenser and a beverage container according to an embodiment of the present invention, wherein the beverage supply device is in an initially-assembled state.
Figure 4:
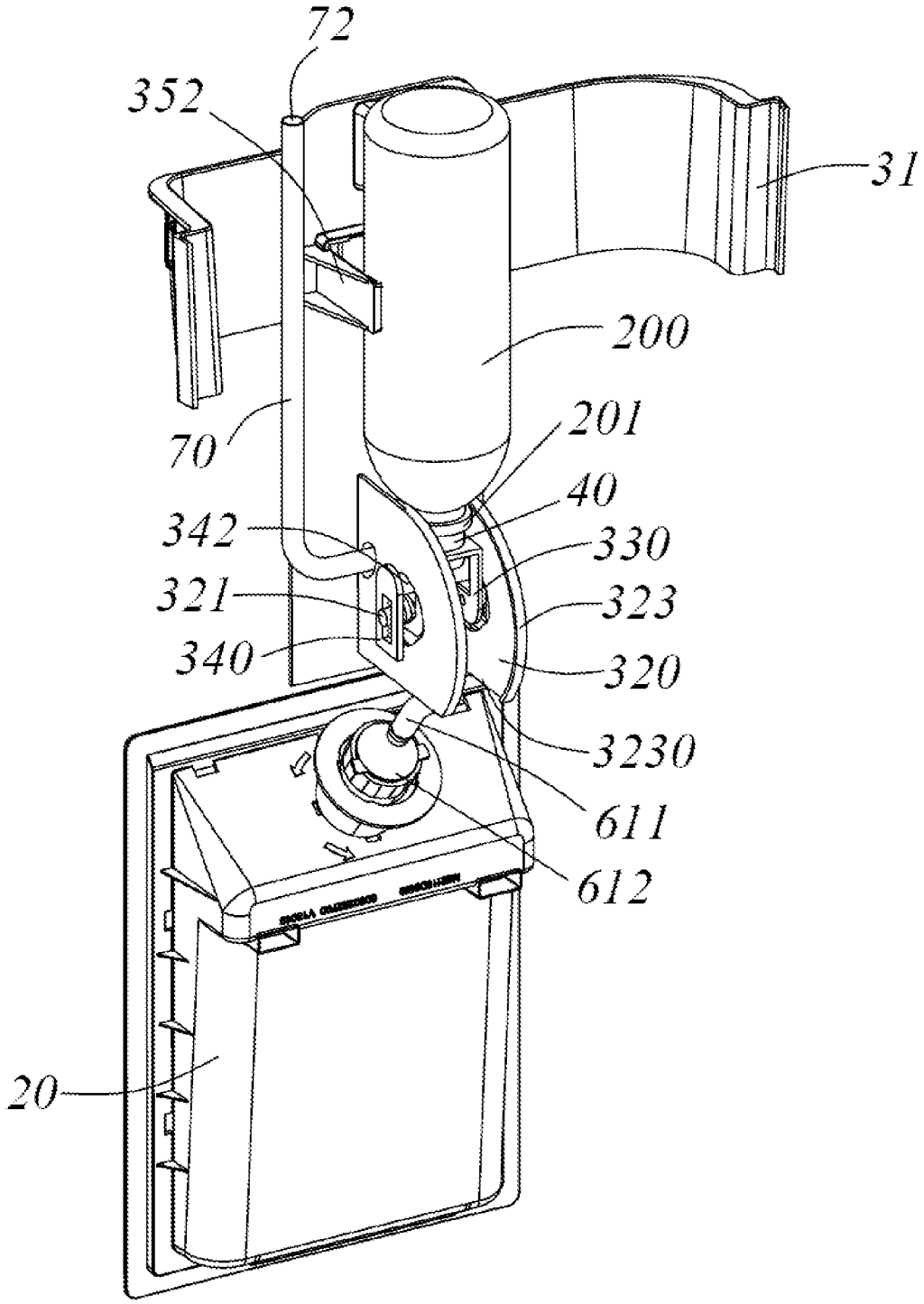
FIG. 4 is a structural schematic view of a combination of a beverage supply device and a dispenser and a beverage container according to an embodiment of the present invention, wherein the beverage supply device is in a fully-assembled state.
Figure 5:
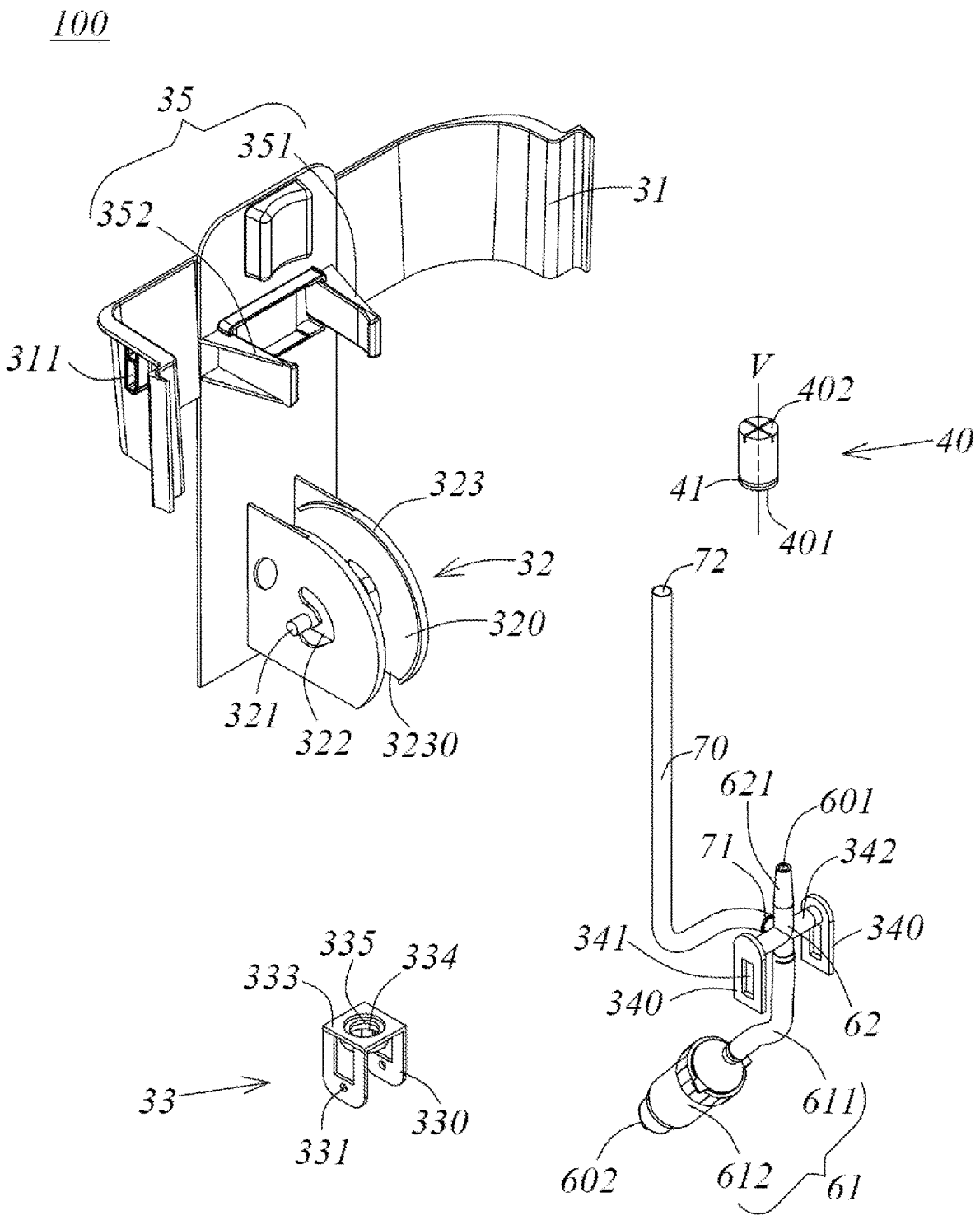
FIG. 5 is an exploded view of a beverage supply device according to an embodiment of the present invention.
Figure 6:
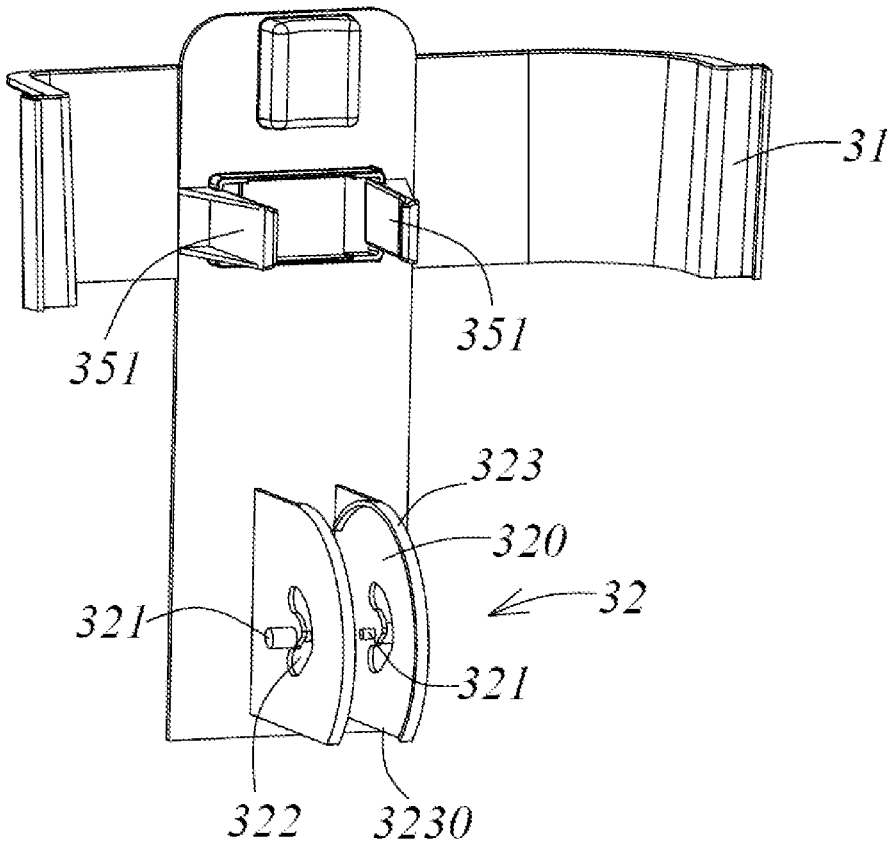
FIG. 6 is a structural schematic view of partial structures of a bracket according to an embodiment of the present invention.

The blocking member 40 is disposed on the adapting seat 33 and rotate synchronously with the adapting seat 33 around the shaft 321. On the rotating path of the blocking member 40, the blocking member 40 has an initially-assembled position as shown in FIG. 3 and a fully-assembled position as shown in FIG. 4, wherein when the blocking member 40 is located at the initially-assembled position, the corresponding beverage supply device 100 is in an initially-assembled state. At this time, the beverage container 200 can approach the blocking member 40 with its mouth higher than the liquid level of the beverage, so as to realize the assembling and fitting of the blocking member 40 and the mouth of the beverage container 20. As such, the beverage will not be spilled even when the beverage container 200 has not yet been fitted to the blocking member 40; when the blocking member 40 is at the fully-assembled position, the corresponding beverage supply device 100 is in a fully-assembled state, whereupon the beverage container 200 is placed vertically upside down or obliquely upside down on the blocking member 40, that is, the mouth of the beverage container 200 is substantially vertically downward or obliquely downward and the mouth of the beverage container 200 is lower than the liquid level of the beverage. As such, if the user needs to take the beverage, the liquid outlet mechanism is controlled to turn on, and the beverage can flow out of the beverage container 200 under the action of gravity. As compared with the prior art, the process in which the beverage flows out of the beverage container 200 needn't use a driving pump, thereby avoiding the noise pollution and energy consumption caused by the driving pump. Furthermore, during the process from the initially-assembled position to the fully-assembled position, the mouth of the beverage container 200 and the blocking member 40 always remain fitted to avoid the leakage of the beverage.

Further, the blocking member 40 comprises a fixed end 401 and a free end 402, the fixed end 401 is connected to the adapting seat 33, and the free end 402 is disposed away from the adapting seat 33 and can be fitted with the mouth of the beverage container 200.

The blocking member 40 is configured to extend from the fixed end 401 to the free end 402 along a first direction V. When the blocking member 40 is located at the initially-assembled position, the first direction V is vertically downward or obliquely downward as in the illustrated embodiment, i.e., extends from the fixed end 401 to the free end 402 vertically downward or obliquely downward. As such, the mouth of the beverage container 200 can be assembled and fitted to the blocking member 401 in a direction opposite to the first direction V (i.e., vertically upward or obliquely upward), to prevent the beverage from spilling out of the beverage container 200 which tilts inward during the assembling and fitting process; when the blocking member 40 rotates from the initially-assembled position to the fully-assembled position, the free end 402 flips above the fixed end 401; correspondingly, when the blocking member 40 is located at the fully-assembled position, the first direction V is obliquely upward or vertically upward in the illustrated embodiment, i.e., extends obliquely upward or vertically upward from the fixed end 401 to the free end 402. In this way, the mouth of the beverage container 200 is located at the lowest point of the beverage container 200 so that the beverage can flow out of the beverage container 200 through the mouth under the action of gravity.

In the present embodiment, the blocking member 40 is configured as a stopper. An outer surface of the stopper is roughly cylindrical or truncated cone-shaped, and has a central axis parallel to the first direction V. The stopper can be inserted into the mouth of the beverage container 200 from the free end 402, and its outer surface can be closely against the inner surface of the mouth of the beverage container 200 to block the mouth of the beverage container 200, so that the interior of the beverage container 200 can only be communicated with the liquid outlet mechanism through the channel 400. Certainly, in the alternative embodiment, the blocking member 40 may also be changed into a cylinder and sleeved outside the mouth of the beverage container 200 from the free end 402.

Preferably, the channel 400 is formed at the central axis of the stopper, runs through the free end 402 and the fixed end 401 and extends along the first direction V, that is, the fixed end 401 and the free end 402 may be connected through the channel 400.

As stated above, the fixed end 401 of the blocking member 40 is connected to the adapting seat 33. Specifically, in the present embodiment, a catch slot 41 is provided at the fixed end 401. The adapting seat 33 comprises an end plate 333, an adapting hole 334 and a snap-fitting rib 335. The end plate 333 is connected between the two adapting plates 330. The end plate 333 and the two adapting plates 330 substantially form a U-shaped structure. When the adapting seat 33 is connected to the supporting seat 32, the two adapting plates 330 are perpendicular to the shaft 321 and the end plate 333 is parallel to the shaft 321. The adapting hole 334 runs through the end plate 333, the fixed end 401 is fitted in the adapting hole 334, and the snap-fitting rib 335 protrudes into the catch slot 41 to prevent the blocking member 40 from moving relative to the adapting seat 33 in the first direction V and prevent the blocking member 40 from moving relative to the adapting seat 33 in a direction opposite to the first direction V. Certainly, in an alternative embodiment, the blocking member 40 may also be fitted with the adapting seat 33 in other manners or integrally formed with the adapting seat 33.

When the fixed end 401 of the blocking member 40 is fitted with the adapting seat 33, the channel 400 extends in a radial direction with the shaft 321 as a central axis. Correspondingly, the first direction V is away from or close to the shaft 321 in the radial direction. In the present embodiment, the fixed end 401 is relatively close to the shaft 321, the free end 402 is relatively away from the shaft 321, and the first direction V is radially away from the shaft 321. Certainly, in an alternative embodiment, the fixed end 401 may be relatively away from the shaft 321, the free end 402 may be relatively close to the shaft 321, and the first direction V is radially close to the shaft 321.

Further, the liquid outlet mechanism comprises a liquid outlet pipe 61 and a liquid injection nozzle 62.

The liquid injection nozzle 62 is inserted into the channel 400 in the first direction V, and its injection end constitutes the lead-in end 601 of the liquid outlet mechanism, i.e., the beverage in the beverage container 200 flows into the liquid outlet mechanism through the injection end of the liquid injection nozzle 62. A discharge end of the liquid injection nozzle 62 is communicated with an injection end of the liquid outlet pipe 61, i.e., the liquid outlet pipe 61 is located downstream of the liquid injection nozzle 62. The liquid outlet pipe 61 comprises a conduit 611 fitted with the liquid injection nozzle 62 and a valve 612 fitted downstream of the conduit 611. The valve 612 is assembled and fixed on the dispenser 20. An end of the valve 612 extends forward until it is exposed in front of the dispenser 20, and constitutes the discharge end 602 of the liquid outlet mechanism, and the valve 612 may control the liquid outlet mechanism to turn on or turn off.

Preferably, when the blocking member 40 is at the fully-assembled position, the liquid outlet pipe 61 is always located below the liquid injection nozzle 62 in the vertical direction, so that the beverage may flow smoothly to the dispenser 20 under the action of gravity.

The bracket further comprises a guide seat that is relatively movably connected to the supporting seat 32, and the guide seat is connected to the liquid injection nozzle 62 so that the liquid injection nozzle 62 moves synchronously with the guide seat relative to the supporting seat 32. Specifically in the present embodiment, the guide seat is rotatably connected to the supporting seat 32 about the shaft 321, and the guide seat may also slide relative to the supporting seat 32 and the blocking member 40 in the radial direction with the shaft 321 as the central axis, i.e., the guide seat may move close to or away from the shaft 321.

When the blocking member 40 moves from the initially-assembled position to the fully-assembled position, the guide seat drives the liquid injection nozzle 62 to rotate with the blocking member 40 synchronously and in the same direction about the shaft 321. At the same time, driven by the guide seat, the liquid injection nozzle 62 moves relative to the blocking member 40 in the first direction V, that is, the liquid injection nozzle 62 generates a movement displacement from the fixed end 401 to the free end 402 relative to the blocking member 40 to increase a distance of intrusion of the liquid injection nozzle 62 into the channel 400, thereby enabling the liquid injection nozzle 62 to be fitted deeper into the channel 400, enhancing the fitting strength of the liquid outlet mechanism and the blocking member 40, and ensuring the reliability that the beverage container 200 outputs the beverage through the liquid outlet mechanism.

Certainly, when the blocking member 40 moves from the fully—assembled position to the initially-assembled position, the guide seat drives the liquid injection nozzle 62 to rotate with the blocking member 40 simultaneously in the same direction around the shaft 321, and meanwhile the guide seat may drive the liquid injection nozzle 62 to move relative to the blocking member 40 in a direction opposite to the first direction V, so that at least part of the liquid injection nozzle 62 is withdrawn from the channel 400.

Specifically, the guide seat comprises two guide plates 340, escape slots 341 and a guided portion 342. The two guide plates 340 are disposed opposite to each other in the left-right direction and are substantially parallel to each other, and the two guide plates 340 correspond to the two supporting plates 320 one to one; the escape grooves 341 are disposed on the guide plates 340 and adapted to the shaft 321, the shaft 321 is inserted into the escape slots 341 and may rotate and slide in the escape slots 341, so that the guide seat and the supporting seat 32 may rotate and slide relatively; the supporting plates 320 are each provided with a guide portion 322, and when the guide seat rotates about the shaft 321 relative to the supporting seat 32, the guide portions 322 engage with the guided portion 342 so that the guide seat radially moves away from or close to the shaft 321 relative to the supporting seat 32.

In the present embodiment, when the blocking member 40 rotates from the initially-assembled position to the fully-assembled position, the guide seat rotates with the blocking member 40 synchronously and in the same direction about the shaft 321 relative to the supporting seat 32, and the guide portions 322 engage with the guided portion 342 so that the guide seat radially moves away from the shaft 321 relative to the supporting seat 32; on the contrary, when the blocking member 40 rotates from the fully-assembled position to the initially-assembled position, the guide seat rotates with the blocking member 40 synchronously and in the same direction about the shaft 321 relative to the supporting seat 32, and the guide portions 322 engage with the guided portion 342 so that the guide seat radially moves close to the shaft 321 relative to the supporting seat 32.

In the present embodiment, the guide portions 322 are guide slots provided around the shaft 321, and the guided portion 342 is set as a cylinder adapted to the guide portions 322 and inserted and fitted in the guide portions 322 in the left-right direction. When the guide seat rotates about the shaft 321 relative to the supporting seat 32, the guided portion 342 may move along the guide portions 322 and be abutted against by the guide portions 322 to move close to or away from the shaft 321.

Figure 7:
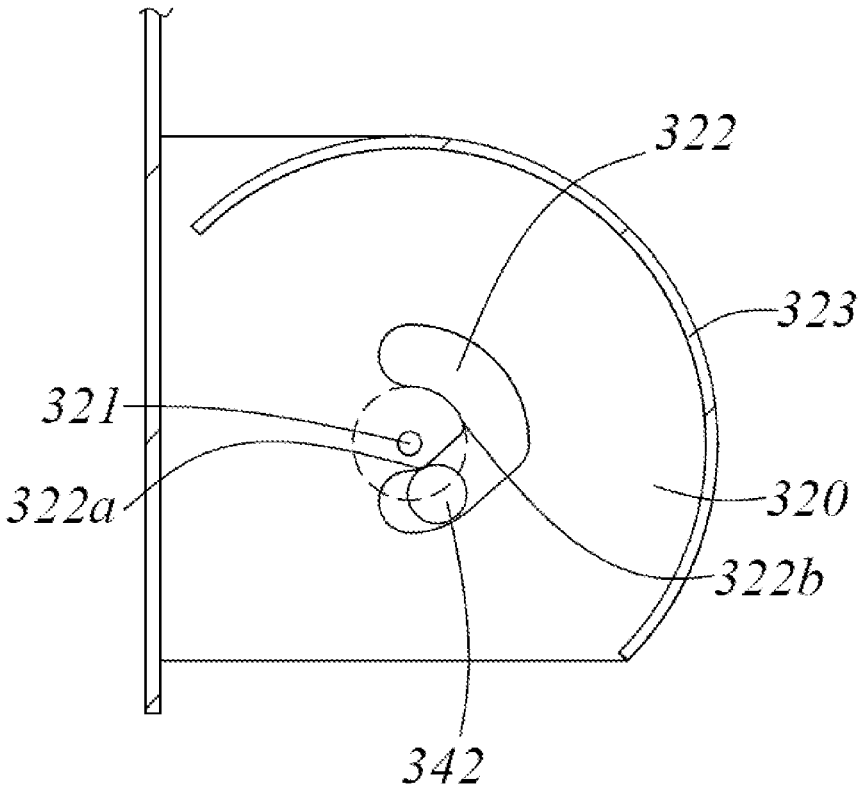
FIG. 7 is a schematic view showing a state in which a supporting seat corresponding to FIG. 3 is engaged with a guided portion.
Figure 8:
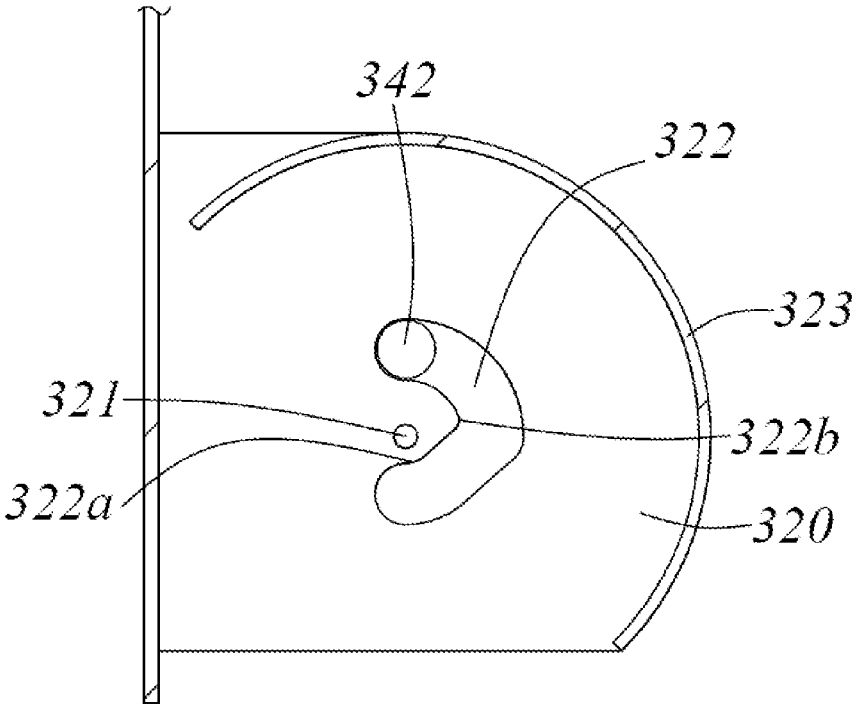
FIG. 8 is a schematic view showing a state in which a supporting seat corresponding to FIG. 4 is engaged with a guided portion.
Figure 9:
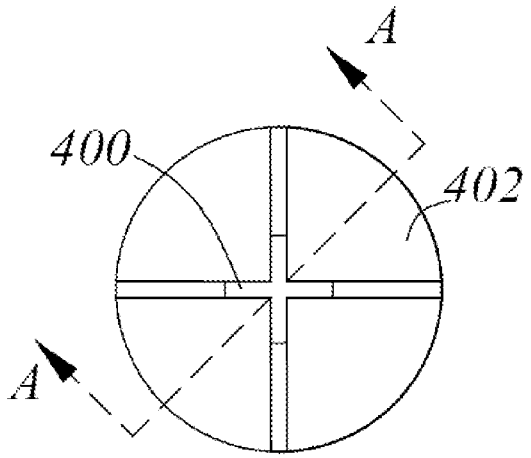
FIG. 9 is a top view of a blocking member according to an embodiment of the present invention.
Figure 10:
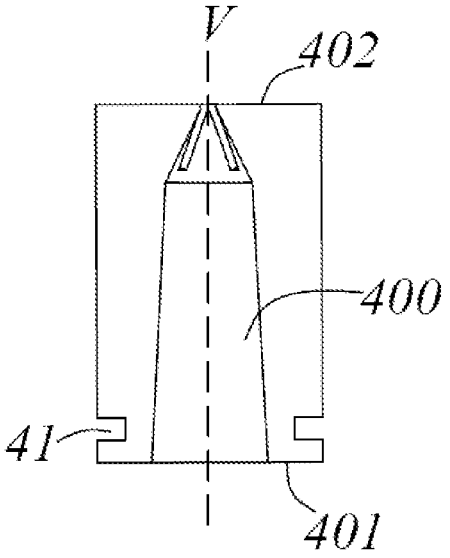
FIG. 10 is a cross-sectional view taken along Line A-A in FIG. 9.

Referring to FIG. 7 and FIG. 8, the guide portion 322 comprises an extremely close position 322*a* closest to the shaft 321 and an extremely distant position 322*b* farthest from the shaft 321. The distance between the guide portion 322 and the shaft 321 gradually increases from the extremely close position 322*a* to the extremely distant position 322*b*; the distance between the guide portion 322 and the shaft 321 remains constant from the extremely distant position 322*b* to an end of the extremely distant position 322*b* away from the extremely close position 322*a*.

Referring to FIG. 7 in conjunction with FIG. 3, when the blocking member 40 is located at the initially-assembled position, the guided portion 342 is located at the extremely close position 322*a*; referring to FIG. 8 in conjunction with FIG. 4, when the blocking member 40 rotates from the initially-assembled position to the fully-assembled position, the guided portion 342 moves along the guide portion 322, and the guided portion 342 first moves from the extremely close position 322*a* to the extremely distant position 322*b*; during this period, abutted against by an inner slot wall (namely, a slot wall on a side of the guide slot relatively close to the shaft 321) of the guide portion 322, the guided portion 342 moves away from the shaft 321, and the guided portion 342 moves beyond the extremely distant position 322*b* and then moves at a constant distance from the shaft 321. On the contrary, when the blocking member 40 rotates from the fully-assembled position to the initially-assembled position, the guided portion 342 moves along the guide portion 322, and the guided portion 342 first moves at a constant distance from the shaft 321 to the extremely distant position 322*b*, and then while the guided portion 342 moves from the extremely distant position 322*b* to the extremely close position 322*a*, the guided portion 342, abutted against by an outer slot wall (namely, a slot wall on a side of the guide slot relatively away from the shaft 321) of the guide portion 322, moves close to the shaft 321.

In the present embodiment, the guided portion 342 is connected between the two guide plates 340 and extends in the left-right direction, and the middle of the guided portion 342 is provided with the liquid injection nozzle 62, the liquid injection nozzle 62 is set as a tube structure crossing with the guided portion 342, and the liquid injection nozzle 62 may be formed integrally with or separately from the guided portion 342.

Furthermore, the blocking member 40 is configured as a flexible stopper, at least a partial area of the channel 400 has a tapering inner diameter in the first direction V, and correspondingly, the liquid injection nozzle 62 comprises a pointed mouth 621 whose outer diameter is reduced in the first direction V; when the blocking member 40 is located at the initially-assembled position, the pointed mouth 621 is inserted into the channel 400 and the outer surface of the pointed mouth 621 is attached to the inner surface of the channel 400. In this way, when the blocking member 40 rotates from the initially-assembled position to the fully-assembled position, the pointed mouth 621 is further inserted into the channel 400 in the first direction V, and the outer surface of the pointed mouth 621 further press tightly the inner surface of the channel 400, thereby enhancing the sealing performance and preventing the leakage.

Further, the free end 402 of the blocking member 40 has at least two elastic claws which surround the channel 400 and gather toward the center of the channel 400. When the blocking member 40 is located at the fully-assembled position, the injection end of the liquid injection nozzle 62 (i.e., the lead-in end 601 or say a tip of the pointed mouth 621) extends out through the free end 402, and drives the elastic claws to flare outward radially away from the center of the channel 400, which may increase the outer diameter of the blocking member 40, enhances the attaching tightness and fitting firmness of the blocking member 40 and the beverage container 200, and preventing the beverage container 200 from inadvertently disengaging from the blocking member 40 or the liquid leakage problem.

Further, the bracket further comprises limiting portions 323 which are adapted to a flange 201 outside the mouth of the beverage container 200. When the blocking member 40 moves from the initially-assembled position to the fully-assembled position, the limiting portions 323 abut against the flange 201 to prevent the beverage container 200 from moving radially away from the shaft 321, i.e., prevent the beverage container 200 from moving away in the first direction V and disengaging from the blocking member 40.

In the present embodiment, the limiting portions 323 are ribs provided on side surfaces of the two supporting plates 320 opposite to each other, i.e., the number of the limiting portion 323 is two, and the two limiting portions 323 respectively protrude from one of the supporting plates 320 towards the other of the supporting plates 320. Preferably, the limiting portion 323 is configured as a circular arc shape with the shaft 321 as the center. Furthermore, an assembling port 3230 is formed at an end of the limiting portion 323, and the assembling port 3230 corresponds to the initially-assembled position. When the blocking member 40 is located at the initially-assembled position, the beverage container 200 may move close to or away from the blocking member 40 through the assembling port 3230. After the beverage container 200 and the blocking member 40 are installed in place, the beverage container 200 may rotate with the blocking member 40 about the shaft 321, and the flange 201 of the beverage container 200 abuts against the inner side of the limiting portion 323 so that its movement away from the shaft 321 is limited. In an alternative embodiment, the limiting portion 323 may also be configured as a groove that mates the flange 201.

Further, a first end 71 of the air inlet tube 70 is fitted at an intersection of the liquid injection nozzle 62 and the guided portion 342, and a three-way structure is constituted in the interior of the intersection position, and an air flow passageway in the air inlet tube 70 is communicated with the liquid injection nozzle 62. A second end 72 of the air inlet tube 70 is exposed to the air, i.e., the air flow passageway in the air inlet tube 70 is communicated with the external. Preferably, the second end 72 is always located above the beverage container 200 in the vertical direction. With the air inlet tube 70 being disposed, when the liquid outlet mechanism is controlled to turn on, the beverage is delivered to the dispenser 20 through the liquid outlet mechanism, and at the same time, the external air can enter the beverage container 200 through the air inlet tube 70 and the liquid injection nozzle 60 in turn to avoid negative pressure and ensure the smooth flow-out of the beverage.

Preferably, at least a portion of the air inlet tube 70 close to the first end 71 is set as a flexible hose. Similarly, at least a portion of the conduit 611 is also set as a flexible hose. In this way, when the beverage supply device 100 transitions from the initially-assembled state to the fully-assembled state, the air inlet tube 70 and the conduit 611 may bend and extend to adapt for changes in their positions.

Further, the bracket further comprises a snap-fitting seat 35. When the blocking member 40 is located at the fully-assembled position, the snap-fitting seat 35 is fitted to at least one of the adapting seat 33, the blocking member 40 and the beverage container 200, to prevent the blocking member 40 from moving away from the completely-assembled position to the initially-assembled position, thereby achieving the purpose of limiting the rotation of the beverage container 200 and avoiding the accidental fall of the beverage container 200. In the present embodiment, the snap-fitting seat 35, by fitting with the beverage container 200, directly prevents the beverage container 200 from rotating about the shaft 321, i.e., indirectly prevents the blocking member 40 from rotating about the shaft 321. Certainly, in an alternative embodiment, the snap-fitting seat 35 may be configured to directly fit with the blocking member 40 or the adapting seat 33, which may also achieve an effect of preventing the beverage container 200 from falling accidently.

Specifically in the present embodiment, the snap-fitting seat 35 comprises an elastic arm 351 and an elastic arm 352. The elastic arm 351 and the elastic arm 352 are arranged opposite to each other in the left-right direction, and enclose to form an accommodating cavity adapted for the beverage container 200. When the blocking member 40 is located at the fully-assembled position, the beverage container 200 is located in the accommodating cavity and held and fixed by the elastic arm 351 and the elastic arm 352 from the left and right sides to prevent the beverage container 200 from shaking or rotating.

The detailed depictions listed above are only specific depictions of the feasible embodiments of the present invention, and they are not intended to limit the extent of protection of the present invention. All equivalent implementations or variations made without departing from the technical spirit of the present invention should be included in the extent of protection of the present invention.

What is claimed is:

1. A beverage supply device, wherein comprising:

a bracket comprising a supporting seat and an adapting seat, the adapting seat being rotatably fitted with the supporting seat about a shaft;

a liquid outlet mechanism controlled to turn on or turn off;

a blocking member fitted with a mouth of a beverage container, the blocking member having a channel fitted with the liquid outlet mechanism, the blocking member being disposed on the adapting seat and rotating synchronously with the adapting seat about the shaft, the blocking member having an initially-assembled position and a fully-assembled position on a rotation path of the blocking member;

when the blocking member is located at the initially-assembled position, the beverage container is fitted to the blocking member in a state that the mouth of the beverage container is higher than a liquid level of the beverage; when the blocking member is located at the fully-assembled position, the beverage container is vertically inverted or obliquely inverted on the blocking member.

2. The beverage supply device according to claim 1, wherein the blocking member comprises a fixed end connected with the adapting seat and a free end fitted with the mouth of the beverage container; the blocking member is configured as a stopper or cylinder extending from the fixed end to the free end in a first direction; when the blocking member is located at the initially-assembled position, the first direction is vertically downward or obliquely downward; when the blocking member is located at the fully-assembled position, the first direction is vertically upward or obliquely upward.

3. The beverage supply device according to claim 1, wherein the liquid outlet mechanism comprises a liquid outlet pipe and a liquid injection nozzle docked upstream of the liquid outlet pipe, the liquid injection nozzle being inserted in the channel in a first direction;

the bracket further comprises a guide seat which is connected with the liquid injection nozzle and the supporting seat respectively, and the guide seat drives the liquid injection nozzle to move relative to the blocking member in the first direction when the blocking member moves from the initially-assembled position to the fully-assembled position.

4. The beverage supply device according to claim 3, wherein the supporting seat is provided with a guide portion which is a guide slot disposed around the shaft;

the guide seat comprises a guided portion which is inserted into the guide slot in a direction parallel to the shaft;

when the blocking member moves from the initially-assembled position to the fully-assembled position, the guide seat rotates about the shaft relative to the supporting seat, the guided portion is movable along the guide slot, and a slot wall of the guide slot abuts against the guided portion so that the guide seat moves relative to the blocking member in the first direction.

5. The beverage supply device according to claim 4, wherein the first direction is away from the shaft in the radial direction;

the bracket further comprises a limiting portion adapted to a flange outside the mouth of the beverage container, and when the blocking member moves from the initially-assembled position to the fully-assembled position, the limiting portion abuts against the flange to prevent the beverage container from radially moving away from the shaft.

6. The beverage supply device according to claim 5, wherein the supporting seat comprises two supporting plates which are oppositely disposed in a direction parallel to the shaft;

the blocking member is disposed between the two supporting plates;

the limiting portion is a rib or a groove provided on side surfaces of the two supporting plates opposite to each other, and structured as a circular arc shape with the shaft as a central axis.

7. The beverage supply device according to claim 3, wherein further comprising an air inlet tube which is communicated with the liquid injection nozzle;

when the blocking member is located at the fully-assembled position, the liquid outlet pipe is always located below the liquid injection nozzle in the vertical direction, and an upper port of the air inlet tube is exposed to the air and vertically located above the beverage container.

8. The beverage supply device according to claim 1, wherein the blocking member comprises a fixed end connected with the adapting seat and a free end fitted with the mouth of the beverage container; the blocking member is configured as a stopper extending in a first direction from the fixed end to the free end, and the channel runs through the free end and the fixed end;

the free end has at least two elastic claws which surround the circumference of the channel and gather toward a center of the channel;

when the blocking member is located at the fully-assembled position, a lead-in end of the liquid outlet mechanism passes through the free end and drives the elastic claws to flare outward radially away from the channel.

9. The beverage supply device according to claim 1, wherein the bracket further comprises a snap-fitting seat; when the blocking member is located at the fully-assembled position, the snap-fitting seat is fitted to at least one of the adapting seat, the blocking member and the beverage container, to prevent the blocking member from moving away from the fully-assembled position to the initially-assembled position;

the snap-fitting seat comprises two elastic arms, the two elastic arms are arranged opposite to each other in a direction parallel to the shaft, and the two elastic arms enclose to form an accommodating cavity adapted for the beverage container.

10. A refrigerator, wherein comprising the beverage supply device according to claim 1.

11. The refrigerator according to claim 10, wherein comprising a cabinet, a door movably assembled on the front of the cabinet and a beverage demanding device; the beverage supply device is disposed on a back portion of the door through the supporting seat, and connected to the beverage demanding device to controllably deliver the beverage to the beverage demanding device.

12. The refrigerator according to claim 11, wherein the beverage demanding device comprises any one or two of an ice maker and a dispenser.

13. The refrigerator according to claim 11, wherein the beverage demanding device comprises a dispenser, the liquid outlet mechanism comprises a liquid outlet pipe and a liquid injection nozzle docked upstream of the liquid outlet pipe, the liquid outlet pipe comprises a conduit fitted with the liquid injection nozzle and a valve fitted downstream of the conduit, and the valve is assembled on the dispenser.

* * * * *